US006578266B2

(12) United States Patent
Chomiak

(10) Patent No.: US 6,578,266 B2
(45) Date of Patent: Jun. 17, 2003

(54) SAFETY UTILITY RAZOR KNIFE

(76) Inventor: Bryant D. Chomiak, 2301 Driftwood Dr., Las Vegas, NV (US) 89107

( * ) Notice: Subject to any disclaimer, the term of this patent is extended or adjusted under 35 U.S.C. 154(b) by 0 days.

(21) Appl. No.: 09/880,414

(22) Filed: Jun. 13, 2001

(65) Prior Publication Data

US 2002/0069536 A1 Jun. 13, 2002

Related U.S. Application Data

(60) Provisional application No. 60/251,758, filed on Dec. 7, 2000.

(51) Int. Cl.[7] ..... B26B 3/00; B26B 29/02

(52) U.S. Cl. ..... 30/2; 30/293

(58) Field of Search ..... 30/2, 293, 294, 30/131, 164, 329

(56) References Cited

U.S. PATENT DOCUMENTS

| | | | | |
|---|---|---|---|---|
| 2,376,887 A | | 5/1945 | Walters | |
| 2,730,800 A | | 1/1956 | Bailey | |
| 2,743,523 A | | 5/1956 | Honey | |
| 3,781,988 A | | 1/1974 | Jones | |
| 4,531,286 A | | 7/1985 | Vito et al. | |
| 4,744,146 A | | 5/1988 | Schmidt | |
| 4,757,612 A | * | 7/1988 | Peyrot | 30/151 |
| 4,899,443 A | | 2/1990 | Beermann | |
| 5,241,750 A | | 9/1993 | Chomiak | |
| 5,943,780 A | | 8/1999 | McIlhatten | |
| 6,178,640 B1 | * | 1/2001 | Votolato | 30/2 |

* cited by examiner

*Primary Examiner*—Douglas D. Watts
(74) *Attorney, Agent, or Firm*—William S. Ramsey

(57) ABSTRACT

A safety utility razor knife is normally maintained in a locked closed condition which protects the user or carrier from accidental injury by the blade. No action on the part of the user or carrier is required to lock the protective hood over the blade. The hood pivots into the open position, exposing the razor blade, when the knife is in use, and automatically self-locks the safety hood immediately after use, requiring no action or adjustment on the part of the user. The knife is designed for easy and convenient use in cutting cartons, and other materials, including but not limited to dry wall, floor coverings, and insulation, etc. The hood is unlocked by the user's thumb by moving a slide forward. The amount of blade exposed may be determined by a hood stop on the shoulder of the knife, or as regulated by the depth of cut cam action dial. This insures that only enough blade is exposed for the task at hand, i.e. when cutting a carton containing cereal boxes, only enough blade to cut the carton without damage to the cereal boxes is exposed. In addition, provisions may be made to control the depth of cut which is made by the safety utility razor knife.

8 Claims, 11 Drawing Sheets

SAFETY UTILITY RAZOR KNIFE

CROSS-REFERENCE TO RELATED APPLICATIONS

This application claims the benefit of copending provisional patent application Ser. No. 60/251,758, filed Dec. 7, 2000, incorporated herein by reference.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

This invention relates to knives with retractable safety sheaths or hoods.

2. Description of Related Art Including Information Disclosed Under 37 CFR 1.97 and 37 CFR 1.98

This invention provides improvements in knives with retractable hoods. This invention provides a knife with a retractable hood with improved durability, reliability, and with a hood that provides enhanced safety and which automatically locks in the closed position.

U.S. Pat. No. 2,376,887 discloses two embodiments of a package cutter having a pivoting mounted guard which covers exposed parts of the blade. The guard has two rearwardly projecting ears, one of which has an opening through which a pivot member is engaged and also has a spring which engages the pivot member and urges the guard to a blade covering position.

U.S. Pat. No. 2,370,800 discloses a safety paper box cutter having a razor blade inserted through an opening of the body where the blade is retained bearing against a body end wall. The guard member is pivoted near the end of the body and is yieldingly held in the operating position by the spring.

U.S. Pat. No. 2,743,523 discloses a carton opening knife with a razor blade which fits into a horizontally extending recess and is secured by a clip member having a run which contains the blade within the confines of the clip member when the clip is in repose.

U.S. Pat. No. 3,781,988 discloses a safety paper carton opening blade holder in which a blade is retained by fingers and a guard is mounted on pivot trunnions above the blade. The guard is biased in a closed position by a spring.

U.S. Pat. No. 4,531,286 discloses a carton cutting knife in which a razor blade is retained by detent means on the blade mounting extension and a blade guard is secured to the knife by a flexible attachment strap.

U.S. Pat. No. 4,744,146 discloses an adjustable-blade safety knife with carton-cutting guide in which the blade is slidably-retained within the handle in the closed position and extends from the end of the handle in the open position and having a guide which constrains the blade to cut the side of the carton at a slightly inclined angle from the horizontal.

U.S. Pat. No. 4,899,443 discloses a safety knife for cardboard with a longitudinally slidable knife blade holder spring-loaded in the direction of the knife handle. The normally retracted blade is extended for use by using a finger to slide a guide within an elongated passage in the blade holder until a stop is encountered.

U.S. Pat. No. 5,241,750 discloses a utility razor safety knife with a normally closed hood which automatically self-locks in the closed position after use without action or adjustment by the operator. It is stabilized in its movement and biased toward the closed position by a yoke with springs attached. The disclosures of this patent are hereby incorporated by reference into this patent application.

U.S. Pat. No. 5,943,780 discloses a cutter for fibrous compressible material such as insulation batting. The cutter has an elongated base with a slot for the blade which normally prevents exposure of the blade but which is depressed by contact with material to be cut and allows the blade to protrude through the slot. A safety bar prevents movement of the base unless the cutter is gripped by the user.

The prior art inventions do not provide a safety knife with the reliable, durable, adjustable and efficient safety features of the present invention.

BRIEF SUMMARY OF THE INVENTION

This invention is an improved safety utility razor knife of the type having a handle, a blade attached to the handle, a blade guard hood pivotally attached to the handle, the blade guard hood normally locked in the closed position by a locking plunger which is normally biased by a spring in the closed position. The locking plunger is released by a slide pushed forward from its resting position. Once a cut has been made and the cutter is lifted from the cut surface, the pressure dependent hood moves into the closed position and is automatically locked in that position by the locking plunger, regardless of the position of the slide. In order to move the hood to the open position and to cut again, the slide must be released and allowed to move to the closed, resting, position, then pushed forward into the open position, thereby unlocking the hood and allowing exposure of the blade and use of the knife.

Such knives are used for cutting paper box cartons, opening packages, cutting sheet materials such as roofing and floor coverings and removing insulation from coated wires.

The knife of this invention has the advantage of a "normally locked" hood, which insures that a knife which is not in actual use is in the safe configuration where the protective hood is locked in the closed protective position without any action on the part of the user or carrier.

In the present invention the hood is biased in the closed position by a hood plunger pin which is urged by a spring to hold the hood in the closed position, thereby preventing exposure of the blade. A slide which is biased by a spring in the closed position retains the hood plunger pin in the closed position and retains the hood in the locked position. In addition, a locking plunger is normally biased in the locked position and provides a mechanism for locking the hood in the locked position.

When it is desired to allow the hood to pivot upward with the exposure of the knife blade, the slide is pressed forward thereby allowing upward movement of the hood plunger pin into a groove in the slide. The upper surface of the groove slopes upward from the front to the back of the slide, thus allowing full upward movement of the hood plunger pin and full exposure of the knife blade when the slide is pressed fully into the forward position. In addition, pushing the slide forward causes the locking plunger to move backward, releasing the hood from the locked position. Completion of a cut and release of the knife from the cut surface allows the hood to snap into the closed position where it is immediately locked in the closed position by the locking plunger. This occurs despite the fact that the slide may be held in the forward position. The slide must be released and allowed to returned to the rearmost locked position and then pushed forward before the hood may be moved to the open position. This is an important safety feature which prevents injury associated with rapid cutting.

Release of the slide by the knife user allows the slide to move immediately to the rear locked position with the positive locking of the hood in the closed position by both the hood plunger and by the locking plunger. The knife now can be used by pressing the slide forward to the open position and pressing the hood against the surface to be cut. The hood now is free to pivot, exposing the edge of the blade.

In a second embodiment of the safety knife, the degree of retraction of the hood, and therefore the depth of cut of the blade, may be adjusted.

It is an object of this invention to provide a safety knife having a number of different safety hood embodiments adopted for specific cutting tasks.

It is an object of this invention to provide a safety knife wherein the retractable hood can be opened only by moving the slide from the closed position to the open position and pressing the hood against a surface to be cut, while the hood locks in the closed position when the knife is lifted from the cut surface regardless of the position of the slide.

It is a further object of this invention to provide a safety knife wherein the blade is positively protected against exposure without the necessity of any action by the user.

It is a further object of this invention to provide a safety knife wherein the hood is retained in the closed position by a positive locking mechanism and by a spring biasing the hood in the closed position.

It is a further object of this invention to provide a safety knife wherein the hood is automatically locked in the closed position when the knife is lifted from the cut surface, whether the slide is in the open position or closed position.

It is a further object of this invention to provide a safety knife wherein the biasing tension of the hood is adjustable.

It is a further object of this invention to provide a safety knife wherein action by the user is required in order to allow exposure of the blade, thereby preventing accidental injury by the blade.

It is a further object of this invention to provide a safety knife wherein the hood is transparent, thereby affording an improved view of the cutting surface for the user.

It is a further object of this invention to provide a safety knife which is stabilized against tilting when resting on a surface.

It is a further object of this invention to provide a safety knife wherein the hood accommodates a cable for use in slitting cable insulation.

It is a further object of this invention to provide a safety knife which is stabilized to ensure a right-angle cut.

It is a further object of this invention to provide a safety knife with an easily replaceable blade.

It is a further object of this invention to provide a safety knife having a grip contoured to insure a firm grip by each finger of the gripping hand, thereby preventing slipping of the knife when in use.

It is a further object of this invention to provide a safety knife wherein the amount of retraction of the hood, and thus the depth of the cut, may be controlled.

It is a further object of this invention to provide a safety knife wherein the movement of the safety slide is stabilized by a rocker pin.

It is a final objective of this invention to provide a safety knife which is safe, effective, reliable, durable, and inexpensive to manufacture without adverse effects on the environment.

DETAILED DESCRIPTION OF THE INVENTION

Figure 1:
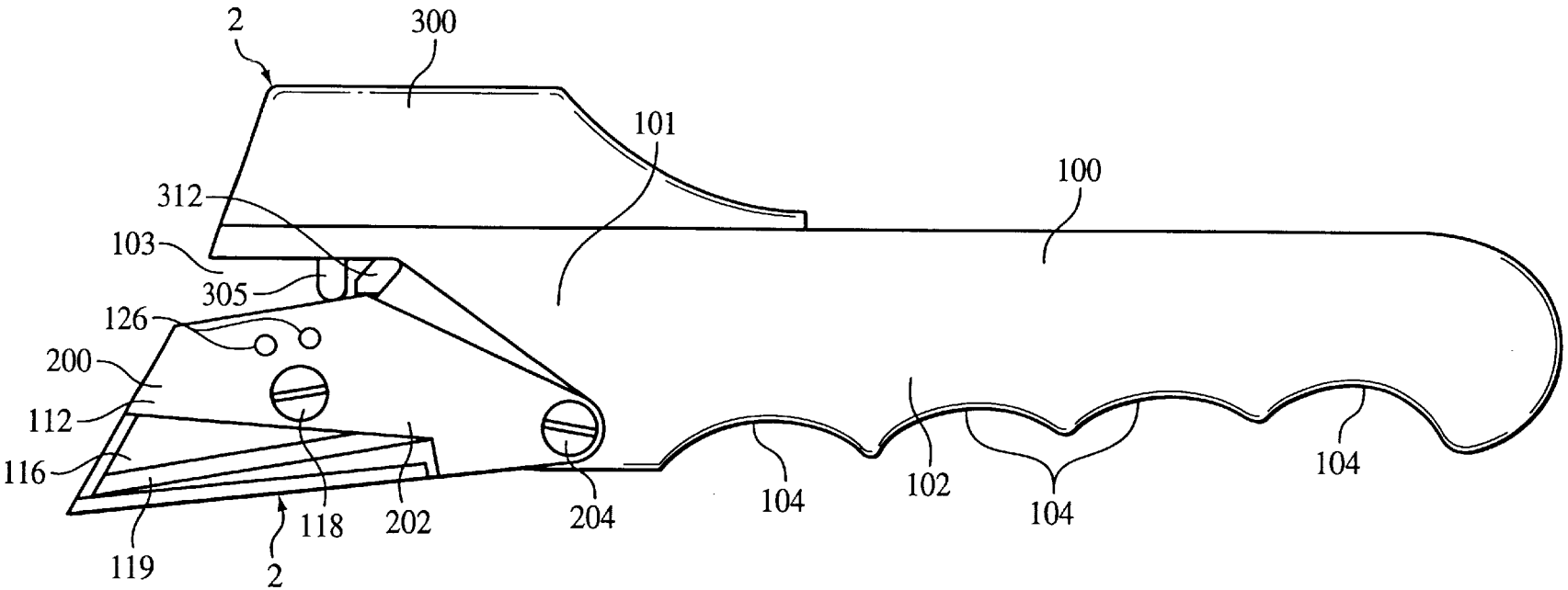
FIG. 1 is a side view of the first embodiment safety knife.

FIG. 1 is a side view of the first embodiment safety knife. Visible in FIG. 1 are the handle 100 to which the blade 116 is attached, as well as the transparent hood 112 which covers the blade, and the slide 300 which is used to unlock the hood when the knife is in use.

The handle 100 is extended to fit the hand of the user and consists of a front portion 101 and a gripping portion 102 at the rear end. The gripping portion 102 is shaped to accommodate either the left or right hand of the user and has four finger grip grooves 104 to insure a safe, firm, and comfortable fit in the user's hand. The handle accommodates users whether they are wearing gloves or not, and whether they have short or long finger nails.

The front portion 101 includes a blade holder escutcheon (not visible in FIG. 1) which is a cut-out in the handle of approximate the shape of the blade and into which the blade fits with one end of the blade protruding from the end of the handle. The trapezoid shaped blade 116 is placed in the blade holder escutcheon and a blade retainer 200 of approximately the shape of the escutcheon covers a portion of the blade and retains the blade in place and provides firm strong reinforcement of the blade against breakage in use by forces lateral to the blade. The blade retainer 200 is attached to the handle by a blade screw 118 which extends through a hole in the blade and the blade holder into a tapped blade screw hole in the handle and retains both the blade 116 and blade retainer 200 in place. Two blade retainer pins 126 extend outward from the escutcheon portion of the handle. These blade retainer pins 126 extend through notches in the blade and into corresponding notches in the blade holder and are fixed in the side of the front portion 101 of the handle 100. The blade retainer pins 126 serve to prevent the pivoting of the blade about the blade screw when the knife is in use. Alternatively, if the handle is injection molded, the blade retention pins may be integral with and extending from the side of the front portion 101 of the handle 100. The sharp edge of the blade 119 extends along the entire bottom of the blade 116.

A transparent hood 112 extends around both sides of the blade and pivots about a hood pivot screw 204. Two hood pivot screws 204 may be used, one on either side of the handle 100, each threaded into the handle. Alternatively, a single hood pivot screw 204 may extend through a threaded hole in the handle and retain the hood on either side of the handle. The use of a single hood pivot screw 204 facilitates the changing of the hood 202 or blade 116.

The top surface of the handle is generally flat with the exception of the front end where a T-shaped fin (360 in FIG. 16A) extends upward. The fin is used to secure the slide 300 to the top of the handle.

A groove 103 is in the front end of the handle. The hood 202 rests on the lower edge of the groove when the hood is in the closed position. Hood 202 is held in the closed position by the hood plunger assembly 305 which is spring biased into the lowered position which holds the hood in the closed position until the hood is pressed into the open position during cutting. A locking plunger 312 extends from back side of the groove 103 and locks the hood in the closed position.

In operation, the slide 300 is pushed toward the front of the knife by the user's thumb with the release of the hood plunger assembly 305 and locking plunger 312, allowing the hood 202 to pivot upward with exposure of the cutting edge 119 of the blade 116.

FIGS. 2–5 depict the internal workings of the safety knife.

Figure 2:
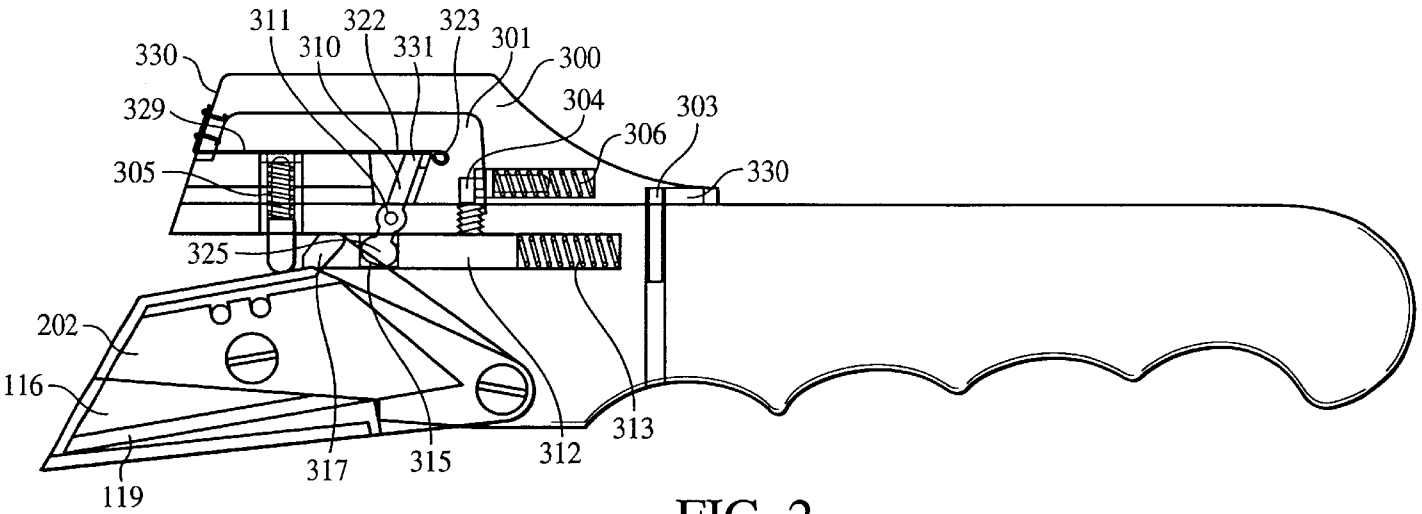
FIG. 2 is a side view of the first embodiment safety knife when the slide is in the rearmost closed position.

FIG. 2 shows additional details on the slide 300. FIGS. 2–5 are sagittal cross sections of the knife of FIG. 1. The slide 300 has an internal cavity 301. A rocker hook 322 is a flat spring which is anchored at the front of the slide 330 and extends through the cavity 301 and has a loop 323 on one end. Additional detail on the structure of the rocker hook 322 is in FIGS. 6A and 6B. A rocker 310 extends into the cavity 301 and pivots about a pivot pin 311 embedded in the front part of the handle 101 and extending through a pivot hole approximately in the middle of the rocker. A rocker ball 325 is formed on one end of the rocker 310. Additional detail on the structure of the rocker is in FIGS. 7A and 7B. A hood plunger assembly 305 extends through the top of the groove. The hood plunger assembly 305 is spring biased to extend down onto the top of the hood and bias the hood into the closed position. The top 329 of the hood plunger assembly 305 bears on the rocker hook 322. Additional detail on the structure of the hood plunger assembly 305 is found in FIG. 9. The rocker ball 325 extends into a locking plunger slot 315 bored through the locking plunger 312. A locking plunger spring 313 biases the locking plunger into the forward locked position. The locking plunger beveled end 317 bears on the top of the hood 202 and locks the hood into the locked position. Additional detail on the structure of the locking plunger is in FIGS. 8A and 8B. A slide plunger 304 extends from the top of the handle 101 into the cavity 301. A slide spring 306 fits into a hole in the slide and bears on the slide plunger 304 and biases the slide to the rear closed position. The slide spring preferably consists of 22 coils of 0.012 inch musical wire. Movement of the slide is controlled by a slide travel pin which extends above the handle and into a slide groove 330.

FIG. 2 shows the knife in the closed locked position when the edge 119 of the blade 116 is covered and protected by the hood 202. In this position, the slide 300 is biased by the slide spring 306 into the closed position where the slide travel pin 303 bears against the front side of the slide groove 330. In the closed position of FIG. 2 the beveled end 317 of the locking plunger 312 extends over the top of the hood 202 and locks the hood in the closed position. The rocker 310 is pivoted so that the ball 325 is in the forward position in the locking plunger slot 315 and the top 331 of the rocker bears against the rocker hook 322. The hood plunger assembly 305 extends against the top of the hood.

Figure 3:
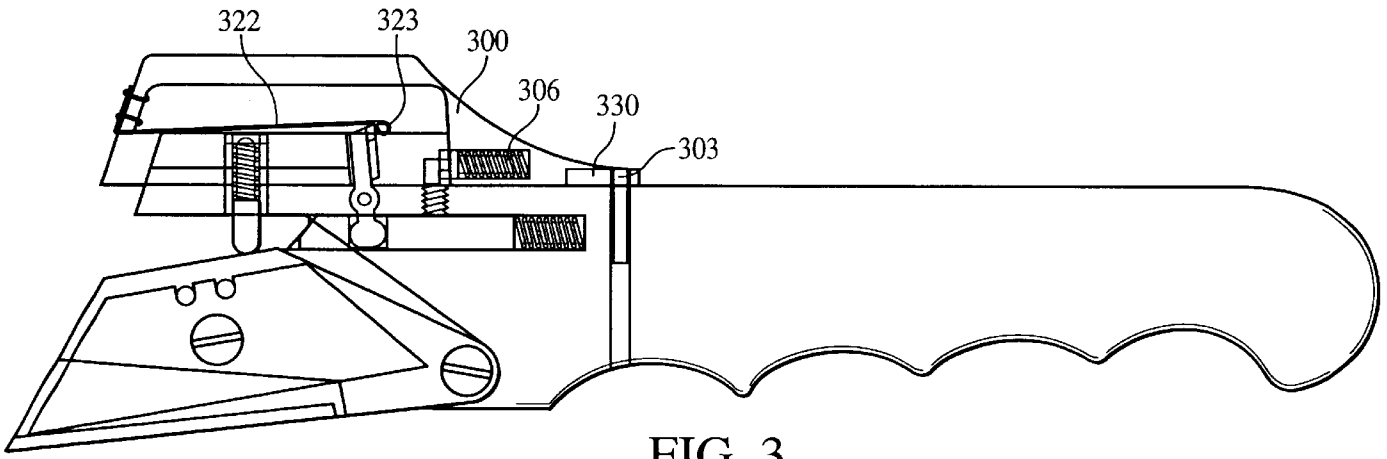
FIG. 3 is a side view of the first embodiment safety knife when the slide is in the forward most open position.

FIG. 3 is the same as FIG. 2 except that the slide 300 has been pushed forward with the back of the slide groove 330 against the slide travel pin 303. The slide spring 306 is compressed by the forward movement of the slide. The forward movement of the slide 300 causes the loop 323 on the end of the rocker hook 322 to engage the top 331 of the rocker 310 and causes the top 331 to move forward. The forward movement of the top 331 of the rocker 310 causes the rocker ball 325 to move toward the rear of the knife. Since the rocker ball 325 extends through a slot 315 in the locking plunger 312, the locking plunger is moved to the rear of the knife, thereby moving the beveled end 317 of the locking plunger to the rear and freeing the hood 202 to move upward.

Figure 4:
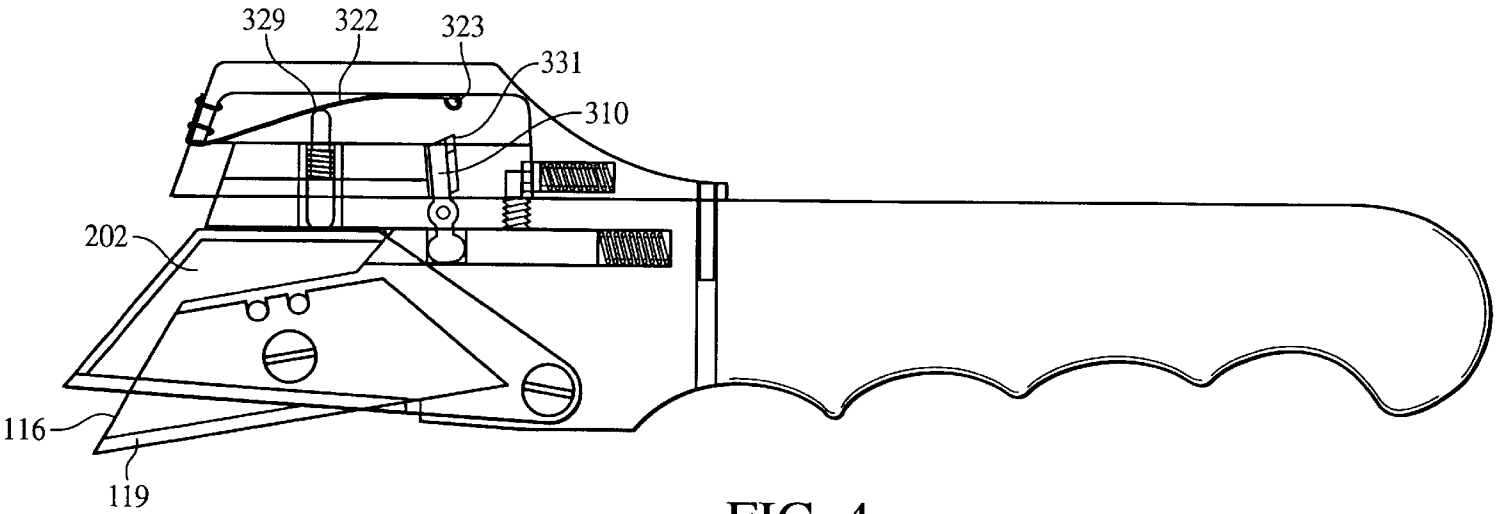
FIG. 4 is a side view of the first embodiment safety knife when the slide is in the forward most open position and the knife hood has been pressed against the surface to be cut and the hood is moved into the open position.

FIG. 4 is the same as FIG. 3 except that the hood 202 has been displaced into the open position because the knife has been pressed against a surface being cut. Movement of the hood 202 into the open position exposes the sharp edge 119 of the knife 116. The maximum exposure of the blade preferably is 0.300 inch. The upward movement of the hood 202 against the hood plunger assembly 305 causes the emergence of the top 329 of the hood plunger assembly 305 which displaces the rocker hook 322 upward. This causes the upward movement of the rocker hook loop 323 and releases the top 331 of the rocker 310.

Figure 5:
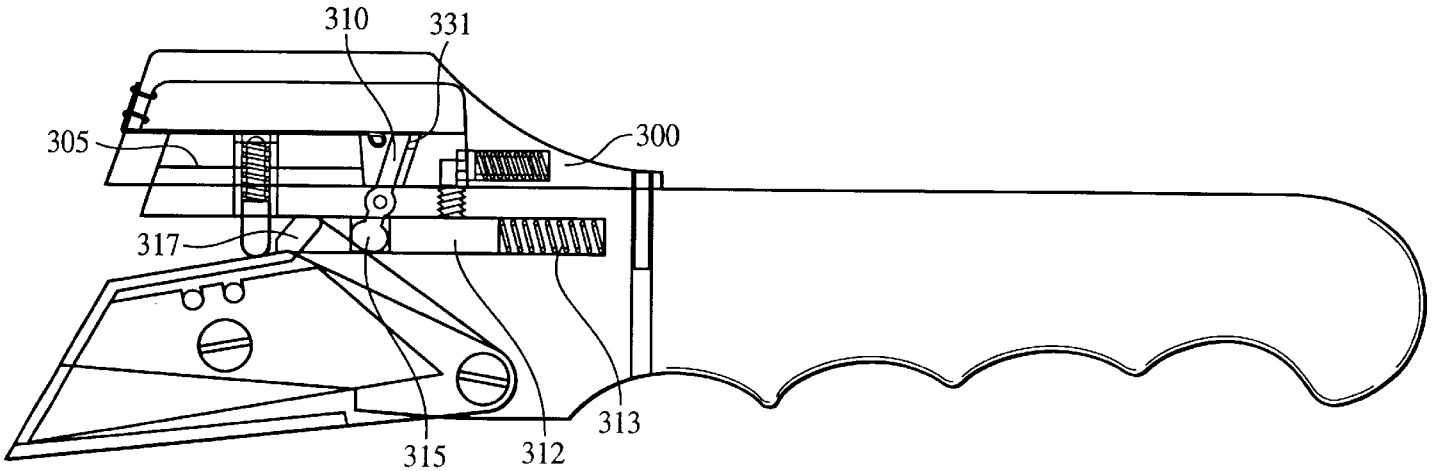
FIG. 5 is a side view of the first embodiment safety knife when the slide is in the forward most open position and the knife hood has been released from the surface after cutting and the hood is moved into the closed position.

FIG. 5 is the same as FIG. 4 except the knife has been lifted from the cut surface and the hood 202 has been moved by the spring in the hood plunger assembly 305 into the closed position which protects the blade. Since the top 331 of the rocker 310 was freed in FIG. 4, the rocker 310 pivots so that the top 331 moves to the rear of the knife and the ball 325 moves forward with the locking plunger 312. The beveled end 317 of the locking plunger 312 is biased forward by the locking plunger spring 313 and locks the hood in the closed position. Thus the lifting of the knife from the cut surface causes the hood to close and lock in a safe position, despite the fact that the slide 300 is still in the forward position. In order to unlock the hood it is necessary to allow the slide to return to the rear locked position and then to push the slide forward into the unlocked position.

Figure 6A:
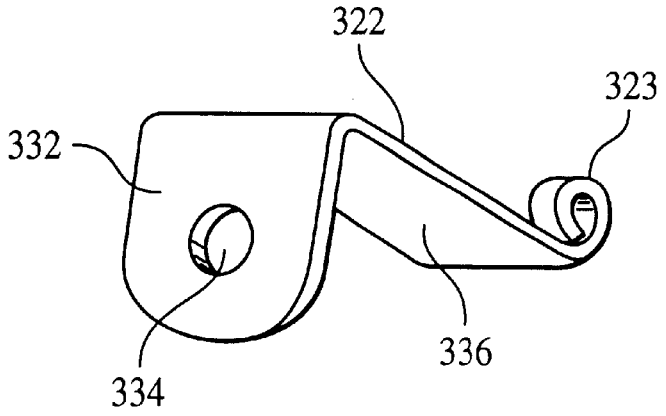
FIG. 6A is a perspective view of the rocker hook.
Figure 6B:
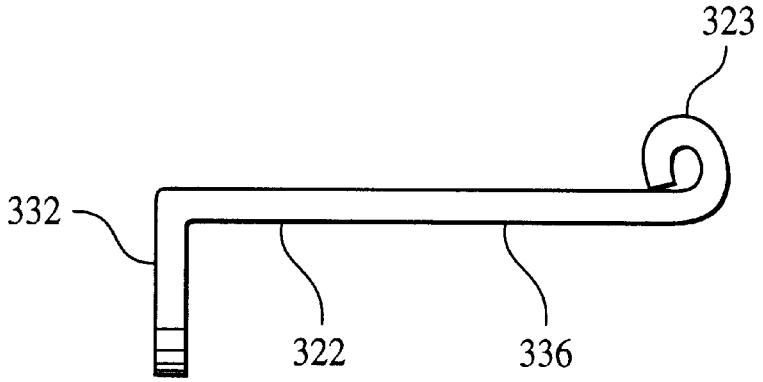
FIG. 6B is a side view of the rocker hook.

FIGS. 6A and 6B provide more details on the rocker hook 322.

FIG. 6A is a perspective view which shows the rocker hook 322 comprised of the rocker hook body 336, the rocker hook loop 323 at one end of the rocker hook, the rocker hook flange 332, which at the other end of the rocker hook and is bent at approximately a right angle to the rocker hook body 336, and on the side of the body opposite to that of the rocker hook loop 323. A hole 334 in the rocker hook flange 332 is used to attach the rocker hook to the front of the slide 330 in FIG. 2 using a screw or other suitable fastener. The rocker hook is preferably 0.012 inch in width.

FIG. 6B is a side view of the rocker hook 322. Visible are the rocker hook body 336, the rocker hook loop 323, and the rocker hook flange 332.

Figure 7A:
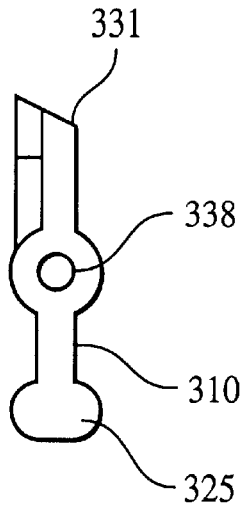
FIG. 7A is a side view of the rocker.
Figure 7B:
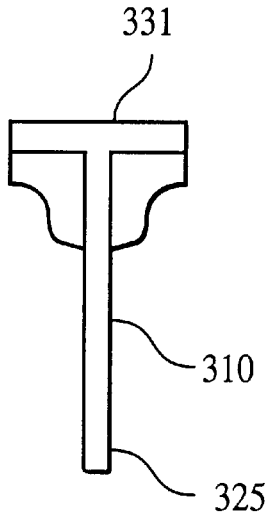
FIG. 7B is a front view of the rocker.

FIGS. 7A and 7B provide more details on the rocker 310.

FIG. 7A is a side view of the rocker 310 showing the rocker top 331, the hole 338 in the rocker for the pivot pin, and the rocker ball 325. In a preferred embodiment the rocker top 331 upper surface is at an angle of approximately 65° to the body of the rocker 310.

FIG. 7B is a front view of the rocker 310 showing the rocker top 331 which is a T-shaped web like structure, and the rocker ball 325.

Figure 8A:
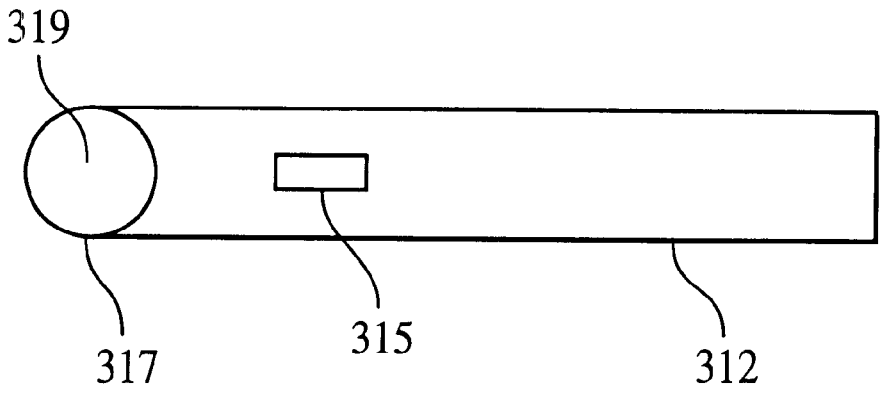
FIG. 8A is a side view of the locking plunger.
Figure 8B:
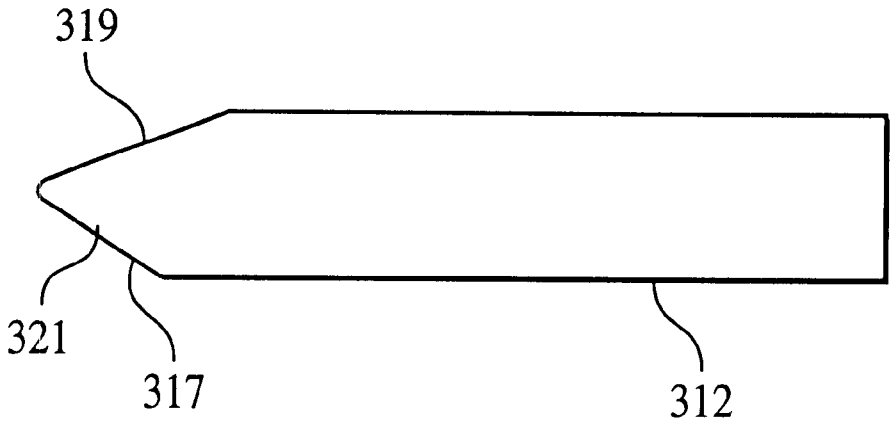
FIG. 8B is a side view of the locking plunger.

FIGS. 8A and 8B provide more details on the locking plunger 312.

FIG. 8A is a top view of the locking plunger 312 showing locking plunger slot 315 which extends through the locking plunger. The top bevel 319 located in the beveled end 317 is shown.

FIG. 8B is a side view of the locking plunger 312 showing the beveled end 317, the top bevel 319, and the bottom bevel 321. In a preferred embodiment the top bevel 319 is at an angle of approximately 50° to a plane perpendicular to the long axis of the locking plunger.

Figure 9:
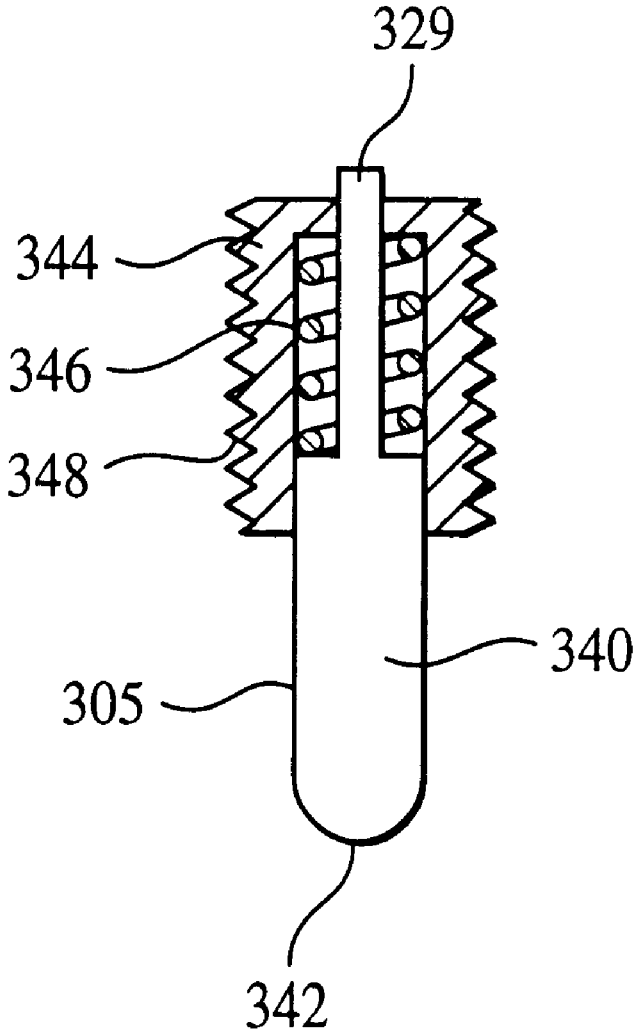
FIG. 9 is a cross section view of the hood plunger assembly.

FIG. 9 is a cross section of the hood plunger assembly 305. The hood plunger is comprised of a hood plunger body 340 which has a hood plunger lower end 342 which bears on the top of the hood. The hood plunger body 340 is necked down to accommodate a hood plunger spring 346 which fits into a cylindrical hood plunger collar 344. The hood plunger spring 346 preferably consists of 12 coils of 0.012 inch musical wire. The outer surface 348 of the hood plunger collar 344 is threaded. The top 329 of the hood plunger is preened so it is retained in the hood plunger collar 344. The hood plunger spring 346 biases the hood plunger body 340 is a downward direction.

Figure 10A:
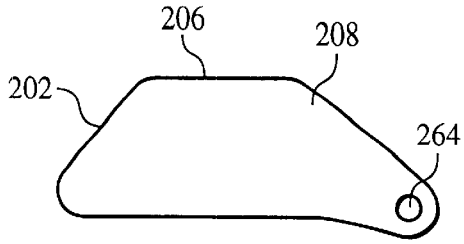
FIG. 10A is a side view of the first embodiment hood.

FIG. 10A is a side view of the first embodiment hood 202. FIG. 10A shows the top of the hood 206, the left side of the hood 208, and the hole 204 for the screw about which the hood pivots when it opens and closes.

Figure 10B:
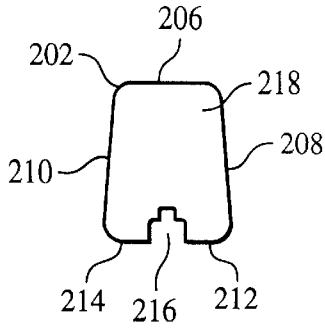
FIG. 10B is an end view of the first embodiment hood.

FIG. 10B is a end view of the first embodiment hood 202. FIG. 10B shows the top of the hood 206, the left side 208, the right side 210, the front of the hood 218, the left bottom side 212, the right bottom side 214, and the opening for the blade 216. The left bottom side is attached approximately perpendicularly to the left side and the right bottom side is attached approximately perpendicular to the right side.

Figure 11A:
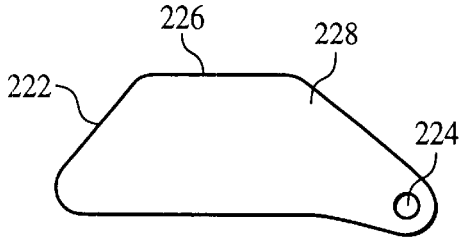
FIG. 11A is a side view of the second embodiment hood.

FIG. 11A is a side view of the second embodiment hood 222. FIG. 11A shows the top of the hood 226, the left side of the hood 228, and the hole 224 for the screw about which the hood pivots when it opens and closes. The second embodiment hood is adapted for the removal of insulation from electrical wires and cables. In use, the length of the cable fits into the inverted-V shape of the bottom of the hood.

Figure 11B:
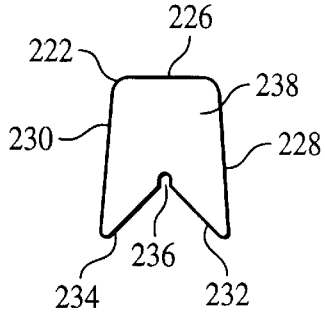
FIG. 11B is an end view of the second embodiment hood.

FIG. 11B is a end view of the second embodiment hood 222. FIG. 11B shows the top of the hood 226, the left side 228, the right side 230, the front of the hood 238, the left bottom side 232, the right bottom side 234, and the opening for the blade 236. The left bottom side 232 is mounted at an angle of approximately 45° to the left side 228. The right bottom side 234 is mounted at an angle of approximately 45° to to the right side 230. The left bottom side 232 and right bottom side 234 form an inverted-V which accommodates a cable or wire to be stripped of a coating, such as an insulation coating.

Figure 12A:
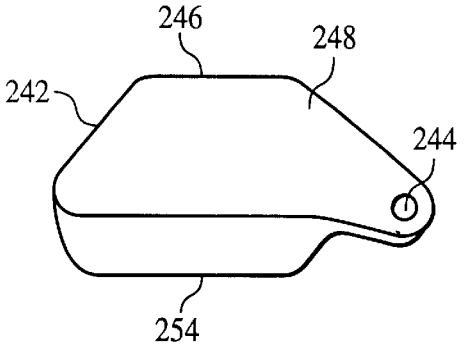
FIG. 12A is a side view of the third embodiment hood.

FIG. 12A is a side view of the third embodiment hood 242. FIG. 12A shows the top of the hood 246, the left side of the hood 248, and the hole 244 for the screw about which the hood pivots when it opens and closes. A fin 254 is extended downwardly from the left side 248.

The third embodiment hood is designed for use in cutting along the top of a case. The fin 254 is placed against the side of a case and the cut is made along the top of the case at a uniform distance from the side of the case.

Figure 12B:
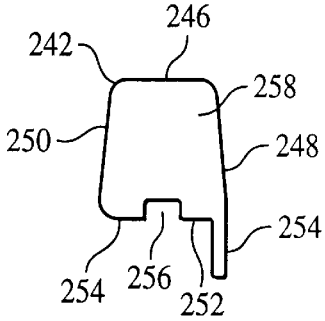
FIG. 12B is an end view of the third embodiment hood.

FIG. 12B is a end view of the third embodiment hood 242. FIG. 12B shows the top of the hood 246, the left side 248, the right side 250, the front of the hood 258, the left bottom side 252, the right bottom side 254, and the opening for the blade 256. The fin 254 is shown extending down from the left side 248.

Figure 13A:
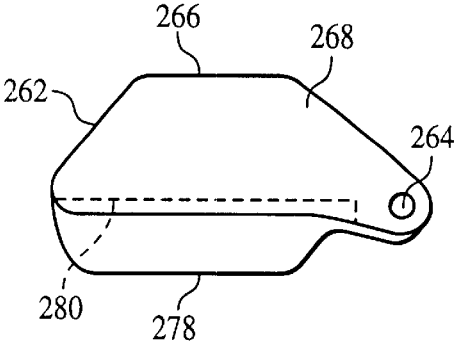
FIG. 13A is a side view of the fourth embodiment hood.

FIG. 13A is a side view of the fourth embodiment hood 262. FIG. 13A shows the top of the hood 266, the left side of the hood 268, and the hole 264 for the screw about which the hood pivots when it opens and closes. The fourth embodiment hood 262 is adapted for case cutting. It includes the fin 278 as in the third embodiment and in addition a flange 280 which extends at an approximate right angle from the right side 270. The flange 280 stabilizes the cutter when cutting the top of a case.

Figure 13B:
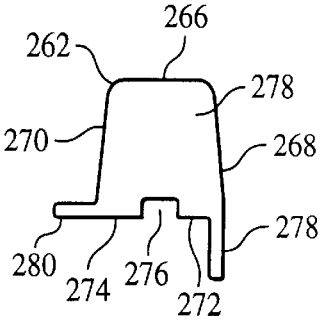
FIG. 13B is an end view of the fourth embodiment hood.

FIG. 13B is a end view of the fourth embodiment hood 262. FIG. 13B shows the top of the hood 266, the left side 268, the right side 270, the front of the hood 278, the left bottom side 272, the right bottom side 274, and the opening for the blade 276. In addition, a fin 278 extends down from the left side 268. A flange 280 extends from the right side 270 approximately perpendicular to the right side 270.

Figure 14:
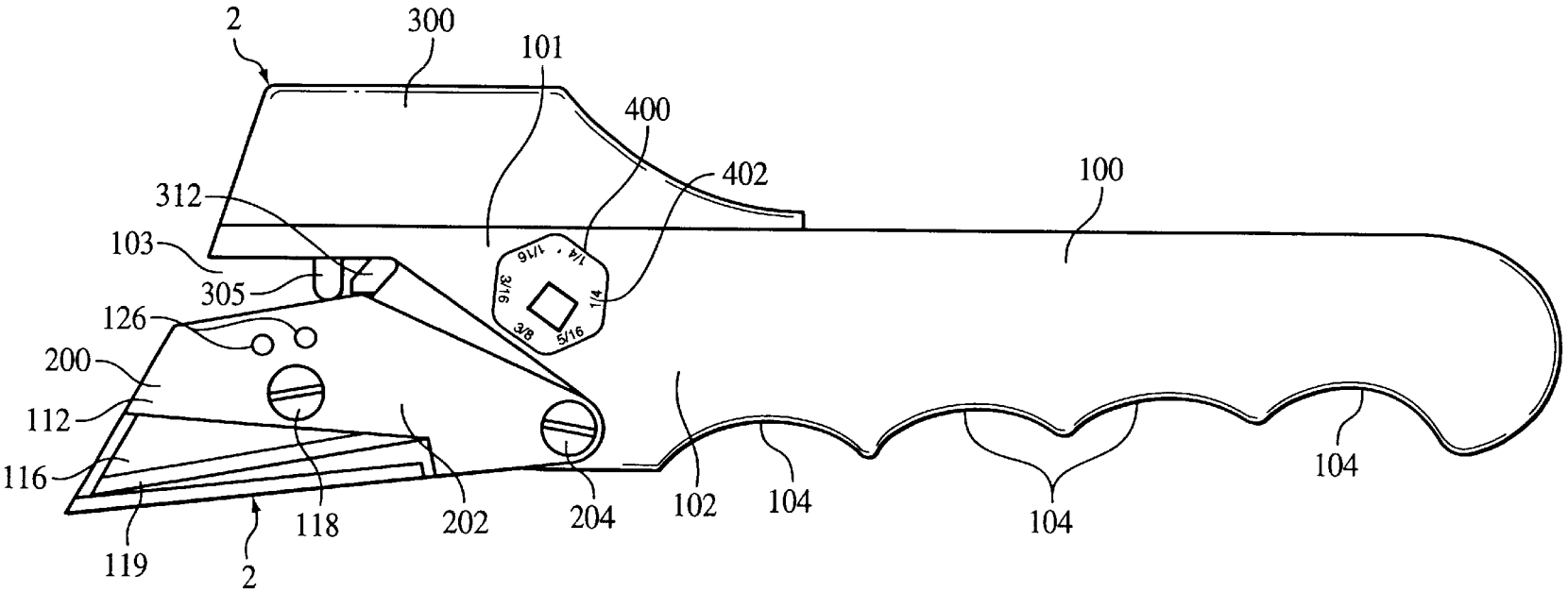
FIG. 14 is a side view of the second embodiment safety knife.

FIG. 14 is a side view of the second embodiment safety knife which is the same as the first embodiment safety knife of FIG. 1 except the second embodiment has the added feature of a mechanism which controls the depth of cut of the safety knife. The depth control 400 is a variable offset cam which is rotatively mounted on the side 101 of the handle 100 of the knife. The control 400 controls the movement of the hood 202 and thereby controls the depth of cut made by the blade 116. Each of the six sides of the control 400 is at a different distance from the center of the control. Rotation of the control allows variation of the depth of cut. Indicia 402 on the face of the control indicate the depth of the cut. The maximum exposure of the blade preferably is 0.300 inch.

Figure 15A:
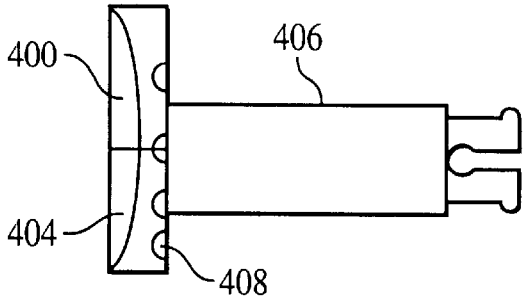
FIG. 15A is a side view of the control of the second embodiment safety knife.

FIG. 15A is a side view of the control 400. The face 404 is a disk with unequal sides which is mounted on the control post 406. The control post 406 is mounted on the side of the cutter. The back of the control has indentations 408 which interacts with a detent on the cutter for restricting free rotation of the control.

Figure 15B:
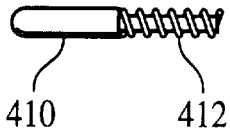
FIG. 15B is a side view of the detent of the second embodiment safety knife.

FIG. 15B shows the detent 410 used to restrict free rotation of the depth control. The detent is inserted into a hole on the side of the cutter, a spring 412 biases the detent outward against an indentation (408 in FIG. 15A) and thereby restricts rotation of the depth control.

Figure 15C:
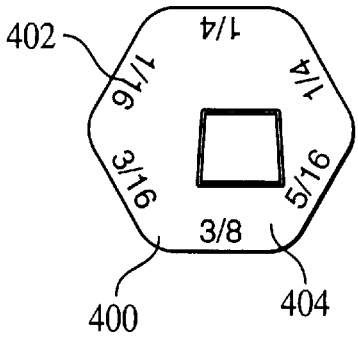
FIG. 15C is a front view of the face of the depth control of the second embodiment safety knife.

FIG. 15C shows the face 404 of the depth control 400 and the indicta 402 used to indicate the depth of the cut.

Figure 16A:
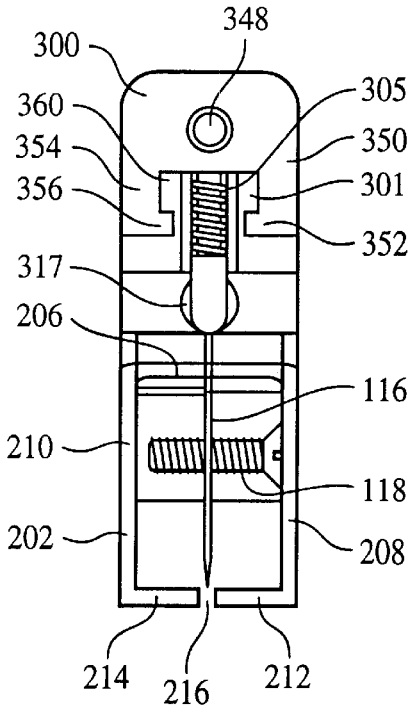
FIG. 16A is a cross section of FIG. 1 along line 2—2.

FIG. 16A is a cross section of FIG. 1 along line 2—2. FIG. 16A shows the slide 300 and the cavity 301 in the slide as well as the screw 348 which retains the rocker hook. The left side 350 of the slide is shown along with the flange 352 at the bottom of the left side 350. The right side 354 of the slide is shown along with the flange 356 at the bottom of the left side 354. The slide fits over a T-shaped fin 360 which is mounted along the top of the safety knife handle. Visible in FIG. 16A is the blade 116 and screw 118 which secures the blade. The hood plunger assembly 305 is shown along with the beveled end 317 of the locking plunger. Also visible in FIG. 16A is the first embodiment hood 202 comprising a right side 210, top 206, left side 208. The left bottom 212 is attached at approximately a right angle to the left side 208. The right bottom 214 is attached at approximately a right angle to the right side 210. The opening 216 for the blade is also visible.

Figure 16B:
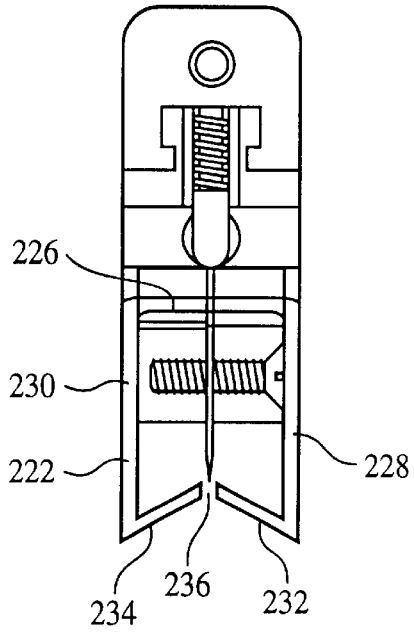
FIG. 16B is a cross section of FIG. 1 along line 2—2 showing the safety knife with the second embodiment hood.

FIG. 16B is the same as FIG. 16A except that a second embodiment hood 222 is used rather than the first embodiment hood. Visible in FIG. 16B is the second embodiment hood 222 comprising a right side 230, top 266, left side 228. The left bottom 232 is attached at approximately a 45° angle to the left side 228. The right bottom 234 is attached at approximately a 45° angle to the right side 230. The left side 232 and right side 234 form an inverted-V. The opening 236 for the blade is also visible.

When the blade becomes dull, its life may be extended by reversing the blade in its mount in the handle, thereby exposing a unused portion of the blade for use. The first step in reversing the blade is to remove the hood. This is accomplished by removing the hood pivot screw (204 in FIG. 1) and pulling the hood forward and off the front end of the safety knife. The blade screw (118 in FIG. 1) is then removed, the blade holder (200 in FIG. 1) is removed, the blade 116 in FIG. 1) is removed and flipped over so the front end of the blade is at the rear of the escutcheon. The blade holder and screw are replace, along with the hood, and the safety knife is ready for use with a previously unused cutting surface available for use. After the entire blade is dulled, a similar process is used to replace the blade with an unused blade.

The handle of the safety knife is constructed out of any strong, resilient, hard material, such as aluminum, steel, or plastic. A preferred material is plastic. If metal is used, the handle can be coated with a resilient material, such as rubber, in order to prevent and relieve user fatigue. Any suitable case cutter type blade may be used with the safety knife. The hood is made of any suitable hard, strong, transparent material, prefereable plastic, such as polymethylmethacrylate or polycarbonate. The rocker hook is made of any suitable resilient material, a preferred material is stainless steel. Other parts of the cutter are made of suitable metals.

It will be apparent to those skilled in the art that the examples and embodiments described herein are by way of illustration and not of limitation, and that other examples may be used without departing from the spirit and scope of the present invention, as set forth in the appended claims.

I claim:

1. A safety utility razor knife comprising:

a handle, a blade attached to the handle, a hood having an open and a closed position, the hood covering the blade when in the closed position, the blade exposed when the hood is in the open position, a slide having a cavity extending along the bottom surface of the slide, the cavity having flanges, a fin extending upward along the front of the top surface of the handle, the slide cavity interacting with the fin and retained on the top surface of the handle by the flanges on the slide cavity, the slide movable along the fin to a forward open position and to a rearward closed position, the slide biased by a spring to the rearward closed position, a locking plunger having an open and a closed position, the locking plunger locking the hood in the closed position when the locking plunger is in the closed position, the locking plunger allowing the hood to move to the open position when the locking plunger is in the open position, a rocker having a rocker top on a first end, a pivot hole approximately in the middle of the rocker, and a rocker ball on the second end, the rocker pivoted at the pivot hole on a pivot pin embedded in the handle, the rocker ball extended into a slot on the locking plunger, a rocker hood with a flange on one end, the rocker hood flange engaged with the rocker top and moving the rocker top to the forward position when the slide is in the forward open position, thereby placing the locking plunger in the backward open position, and allowing the hood to move into the open position, and a hood plunger assembly which is displaced upward when the hood is displaced upward into the open position, the hood plunger assembly displacing the rocker hook upward when the hood plunger assembly is displaced upward, thereby disengaging the rocker hood flange from the rocker top, allowing the rocker to pivot and the locking plunger to move into the closed position, whereby movement of the slide from the rearward closed position to the forward open position causes the locking plunger to move to the open position, and movement of the hood to the closed position causes the locking plunger to move to the closed position.

2. The knife of claim 1 further comprising:

finger grips on the handle.

3. The knife of claim 1 further comprising:

a blade holder which retains the blade, blade retainer pins which prevent pivoting of the blade, and a blade screw which retains the blade and blade holder in place on the handle.

4. The safety utility razor knife of claim 1 wherein the hood further comprises a top, a right, and a left side attached to the top, a front, the front attached to the top, the left side, and the right side, a left bottom side attached approximately perpendicular to the left side, a right bottom side attached approximately perpendicularly to the right side, and an opening between the left and bottom sides.

5. The hood of claim 4 wherein the left bottom side is mounted at an angle of approximately 45° to the left side, and the right bottom side is mounted at an angle of approximately 45° to the right side.

6. The hood of claim 4 further comprising a fin which extends downward from the left side.

7. The hood of claim 6 further comprising a flange which extends approximately perpendicular from the right side.

8. The safety utility razor knife of claim 1 further comprising:

a variable offset cam mounted on the side of the knife handle, the cam controlling the movement of the hood.

* * * * *